United States Patent [19]

Hasegawa

[11] Patent Number: 5,018,466

[45] Date of Patent: May 28, 1991

[54] SEWING MACHINE

[75] Inventor: Hiroshi Hasegawa, Hirakata, Japan

[73] Assignee: Matsushita Electric Industrial Co., Ltd., Kadoma, Japan

[21] Appl. No.: 427,348

[22] Filed: Oct. 27, 1989

[30] Foreign Application Priority Data

Oct. 28, 1988 [JP] Japan ..... 63-273520

[51] Int. Cl.[5] ..... D05B 69/18

[52] U.S. Cl. ..... 112/275

[58] Field of Search ..... 112/275, 277, 272, 220, 112/121.11, 316, 317, 221

[56] References Cited

U.S. PATENT DOCUMENTS

| | | | |
|---|---|---|---|
| 4,195,585 | 4/1980 | Takahashi et al. | 112/277 |
| 4,315,472 | 2/1982 | Makabe et al. | 112/277 X |
| 4,490,656 | 12/1984 | Arnold | 112/277 X |
| 4,498,078 | 2/1985 | Yoshimura et al. | 112/277 X |

FOREIGN PATENT DOCUMENTS

| | | |
|---|---|---|
| 0176599 | 4/1986 | European Pat. Off. . |
| 2184568 | 6/1987 | United Kingdom . |

*Primary Examiner*—Peter Nerbun

*Attorney, Agent, or Firm*—Cushman, Darby & Cushman

[57] ABSTRACT

A sewing machine rotates a motor in reverse direction through a predetermined angle for giving an impetus to a needle to penetrate a thick and heavy cloth when a time period from starting of sewing to a completion of a first stitch is longer than a predetermined time period.

3 Claims, 9 Drawing Sheets

SEWING MACHINE

BACKGROUND OF THE INVENTION

1. Field of the Invention

The present invention relates to a sewing machine, and especially relates to a sewing machine for industrial use such as sewing of thick and heavy cloth.

2. Description of Prior Art:

Recently as a sewing machine for industrial use, those that stop at a regular position have been used to enable unskilled workers to work with high quality and high efficiency.

The general configuration of a prior art sewing machine is illustrated with reference to FIG. 9.

In FIG. 9, a sewing machine 1 is driven by an electric motor 3 via a belt 2. When a control pedal 4 is pressed down forward, a pedal sensor 5 detects depth of the control pedal 4. A speed signal generator 7 generates speed signals corresponding to output data from the pedal sensor 5. A controller 6 controls the motor 3 to rotate in a speed corresponding to press-down degree of the pedal 4, based on the speed signal from the speed signal generator 7. When the pedal 4 is restored to the neutral position, the rotation speed of the motor 3 is decreased. After that, rotation of the motor 3 is retained in a slow rotation speed until a needle position detector 8 detects that the needle reaches a first position to be stopped. Furthermore, when the needle position detector 8 issues an output signal, the motor 3 is stopped of the rotation and driving of the sewing machine 1 is also stopped. The above-mentioned operations are generally called the regular position stopping of the sewing machine.

Furthermore, when the pedal 4 is heeled back, the motor 3 rotates in a constant speed and when it stops the needle is stopped at a second position by receiving a signal from the needle position detector 8. At the second position, the needle is drawn out upward from the cloth (needle-up position), thereby to enable the cloth being taken out and in the sewing machine 1.

The above-mentioned conventional sewing machine having the regular position stopping mode, however, is designed for a light load, and if it were used for a heavier load it would have a disadvantage of overload of the motor 3 and inherent locking of the needle at a first stitch when a heavy cloth is newly inserted in the sewing machine. Such a disadvantageous phenomenon is especially conspicuous in case of using a thick needle for sewing thick and heavy cloth. In the worst case, sewing can not be done and the motor 3 may burn-out when such a trouble is left as it is. Accordingly, it has been necessary to increase power of the motor or to give an impetus to the sewing machine at a first stitch by human hand for sewing heavy load such as thick and heavy cloth by the conventional sewing machine.

SUMMARY OF THE INVENTION

It is an object of the present invention to provide an improved sewing machine which can sew a heavy load without increase of motor power.

A sewing machine in accordance with the present invention comprises:

a motor for driving the sewing machine;

needle position detecting means for detecting position of a needle of the sewing machine and outputting a needle position signal;

speed control means for controlling rotation speed of the motor; and sequence control means for controlling driving and stopping of the motor responding to depth of a pedal and outputting a signal to the speed control means, thereby driving the motor in a reversal direction for a predetermined angle when a needle-down signal of first stitch does not come within a predetermined time period from a start of said driving.

When the falling speed of needle for the first stitch is longer than the predetermined time, the needle cannot penetrate the cloth because of, for example, thickness and heaviness of the cloth. Accordingly, in the sewing machine in accordance with the present invention, the motor is once rotated in a reverse direction for a predetermined angle larger than that which it would have from its initial position as a preliminary motion by control of the sequence control means and thereafter in the normal direction again. Thereby, the needle is given an impetus, larger than that in the first stitch, to penetrate the thick and heavy cloth without increasing the power of the motor.

It will be recognized that some or all of the Figures are schematic representations for purposes of illustration and do not necessarily depict the actual relative sizes or locations of the elements shown.

DESCRIPTION OF PREFERRED EMBODIMENTS

A first preferred embodiment of a sewing machine in accordance with the present invention is described with reference to FIGS. 1, 2 and 3.

Figure 1:
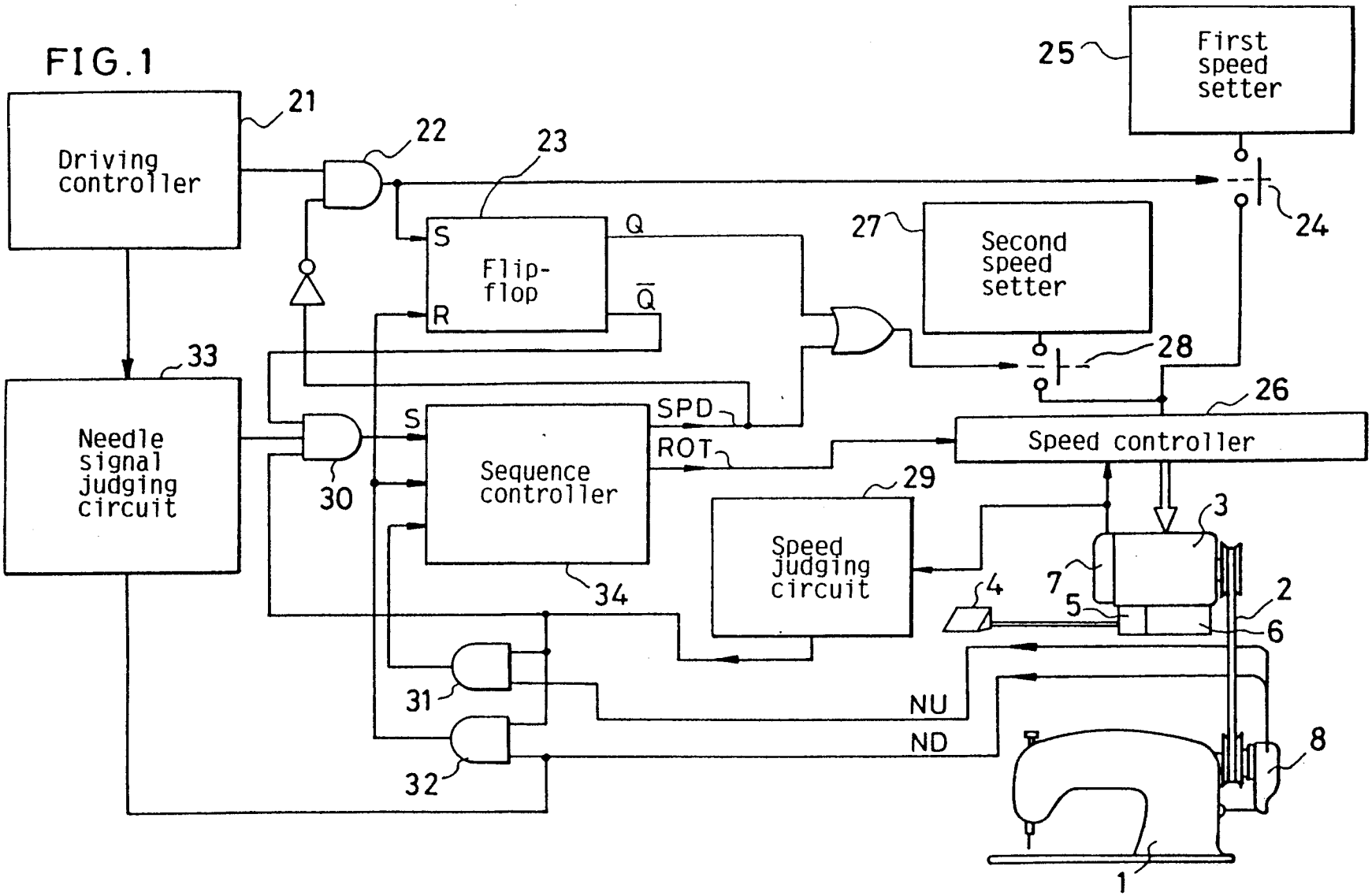
FIG. 1 is a block diagram showing construction of each embodiment of a sewing machine in accordance with the present invention.
Figure 9:
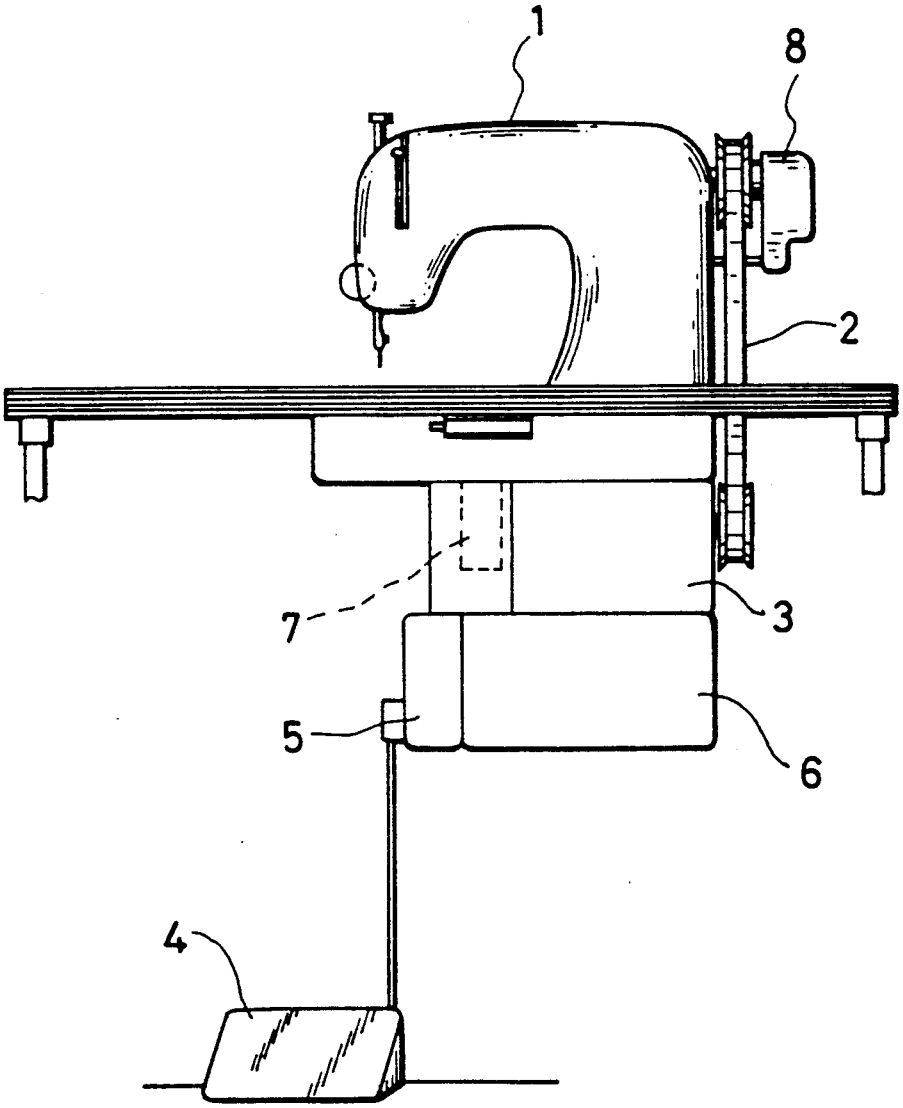
FIG. 9 (Prior Art)
FIG. 9 is a front view showing construction of a typical sewing machine.

FIG. 1 is a block diagram showing the construction of the sewing machine in accordance with a first, a second and a third embodiments. In FIG. 1, a driving controller 21 outputs a signal corresponding to the signal of the pedal sensor 5 for detecting the motion of the pedal 4 of the conventional sewing machine shown in FIG. 9. Output ends of the driving controller 21 is connected via an AND circuit 22 to a flip-flop 23 and a control input of a first switch 24.

Output end of a first speed setter 25 is connected to a speed controller 26 via the first switch 24. In this embodiment, printed circuit board of the first speed setter 25 is contained in the pedal sensor 5 and outputs a signal of speed value which is previously set and corresponding to a depth (pressed-down degree) of the pedal 4. A second speed setter 27 is connected to the afore-mentioned speed controller 26 via a second switch 28.

A speed judging circuit 29 receives signal from a speed signal generator 7 which is mounted on the motor 3 and is connected to a sequence controller 34 via AND circuits 30, 31 and 32. A needle position detector 8 is provided on the sewing machine 1 and outputs a needle-up signal NU and a needle-down signal ND. These signals are input to the sequence controller 34 via the AND circuits 31 and 32. The needle-down signal ND is also input to a needle signal judging circuit 33. The needle signal judging circuit 33 outputs a signal when a front edge of the needle-down signal ND is detected to be longer than a predetermined time period after pressing down of the pedal 4.

In this embodiment, a D.C. brushless motor is used as the motor 3. The afore-mentioned speed signal generator 7 outputs two signals, have phase relations thereof which are shifted from each other, and the afore-mentioned speed controller 26 judges the direction of rotation of the motor 3 from the phase relation of the two signals and controls the direction of the rotation of the motor 3. The motor 3 drives the sewing machine 1 via the belt 2.

Regular-position stopping operation of the above-mentioned sewing machine in accordance with the present invention is described. When the pedal 4 is pressed down, the driving controller 21 contained in the pedal sensor 5 outputs a signal and at the same time the first speed setter 25 sets the speed value in digital data. The first speed setter 25 outputs a digital signal for controlling the rotation speed of the motor 3 corresponding to the depth of stepping down of the pedal 4. The driving controller 21 turns on the first switch 24 for connecting the first speed setter 25 to the speed controller 26.

The speed controller 26 controls the direction of the rotation of the motor 3 by comparing the two signals from the speed signal generator 7 to rotate the motor 3 in the normal direction. And the speed controller 26 controls speed corresponding to the signal given from the first speed setter 25 when it receives a command for rotation such as normal-direction-ROT signal which is given from the sequence controller 34 and transmitted on an output line ROT in case of pressing down of the pedal 4. At that time, the flip-flop 23 is reset. Thereby, the motor 3 continues to rotate in the rotation speed set by the second speed setter 27, even after restoration of the pedal 4 to the neutral position and the driving controller 21's stopping to issue its output.

Generally, the rotation speed set by the second speed setter 27 is selected to be appropriately slow for enabling immediate stopping of the needle when the needle position detector 8 detects reaching of the needle to the position of stopping.

When the driving controller 21 stops to issue the output, the rotation speed of the motor 3 is suddenly reduced. After that, when the speed judging circuit 29 judges that the rotation speed of the motor 3 has been sufficiently reduced to a speed by which the motor 3 can be stopped at once, the flip-flop 23 is reset by the signal from the needle position detector 8 to a rest signal input terminal thereof. When the flip-flop 23 is reset, the second switch 28 is turned off and thereby the motor 3 is stopped to rotate.

In the above-mentioned embodiment, the sequence controller 34 controls the rotation in normal and inverse directions of the motor 3, by outputting the signal ROT on the output line ROT. The ROT signal is changed to high and low corresponding to the existence and non-existence of the needle-down signal ND, respectively in one period of the stitch, given through the needle signal judging circuit 33.

Figure 2:
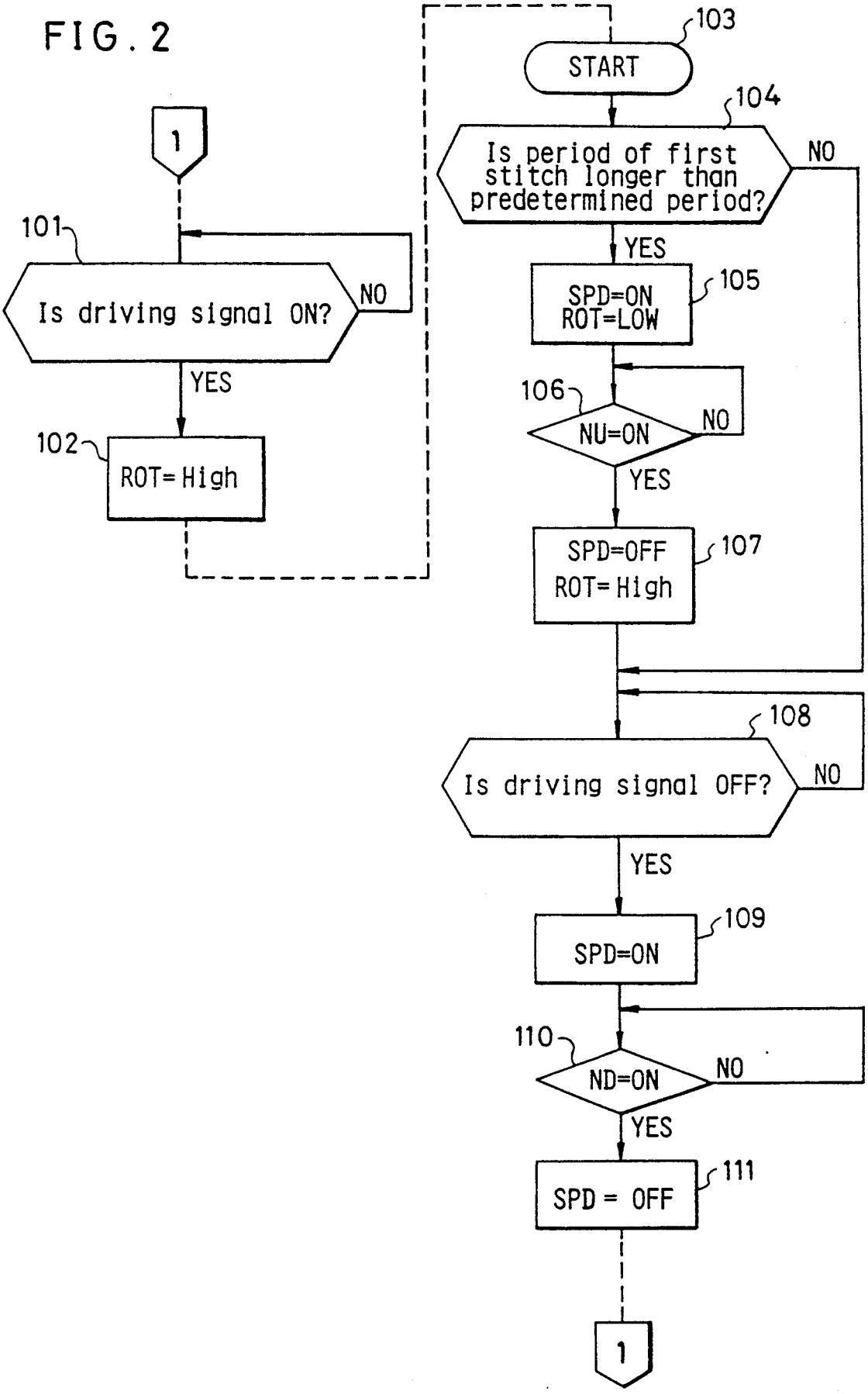
FIG. 2 is a flow chart showing operations of a sequence control means in a first embodiment of the sewing machine in accordance with the present invention.
Figure 3:
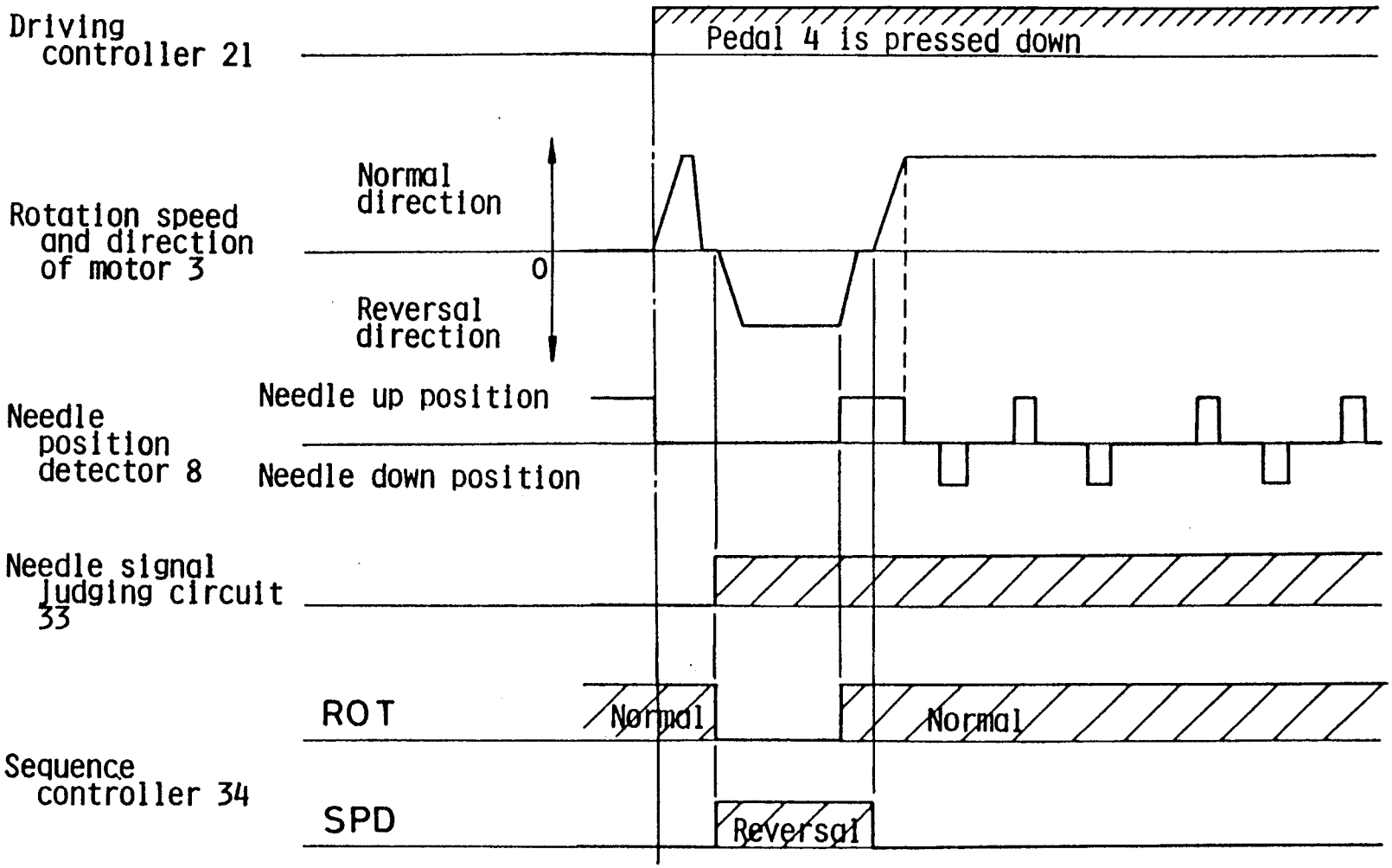
FIG. 3 is a timing chart in the sewing machine in the first embodiment shown in FIG. 2.

Operations of the sequence controller 34 is described further, referring to FIGS. 2 and 3.

When the pedal 4 is pressed down forward, the driving controller 21 outputs a signal (Step 101). The needle signal judging circuit 33, which is a counter, starts to count a time period from the time of start of driving of the motor 3 to a time when the front edge of the signal ND of needle-down position is input by receiving the signal from the driving controller 21 (Step 103). In case that the counted time period is longer than the predetermined time period (in Step 104), the needle signal judging circuit 33 outputs a signal to the sequence controller via the AND circuit 30. Thereby, the sequence controller 34 outputs a SPD signal on the output line SPD (Step 105). The second switch 28 is turned off by receiving the SPD signal. Thereby, the signal from the second speed setter 27 is input to the speed controller 26.

On the other hand, the ROT signal from the sequence controller 34 is outputted to reverse the direction of the rotation of the motor 3 from the normal direction (Step 105). In this embodiment, "high" level of the ROT signal corresponds to the normal direction of the rotation of the motor 3 and "low" level to the reverse direction. When the signal from the second speed setter 27 induced by the SPD signal and the ROT signal are input to the speed controller 26, the motor 3 is controlled to rotate in the predetermined rotation speed and direction.

Thereafter, when the needle position detector 8 detects the needle reaching the needle-up position, the needle position detector 8 outputs the needle-up signal NU to the sequence controller 34 via the AND circuit 31 (Step 106). The sequence controller 34 stops issue of the SPD signal and outputs the ROT signal at high level thereby to rotate the motor 3 in the normal direction (Step 107). When the SPD signal is stopped, the speed controller 26 continues the same operation of the above-mentioned case when the pedal 4 is pressed down.

Steps 108 to 111 designates the known stopping operation of the sewing machine, and thereby, details are omitted.

As a result, even when the cloth is thick and heavy and the needle can not penetrate the cloth in a first stitch, namely, when the time period from the start of driving of the motor 3 to a time of reception of the front edge of pulse of the needle-down signal ND is longer than the predetermined time period, the motor 3 is rotated in the reverse direction. This rotation lasts until the needle reaches the needle-up position. And after the reach of needle, the motor is rotated in the normal direction thereby to give the impetus to penetrate the thick and heavy cloth.

Figure 4:
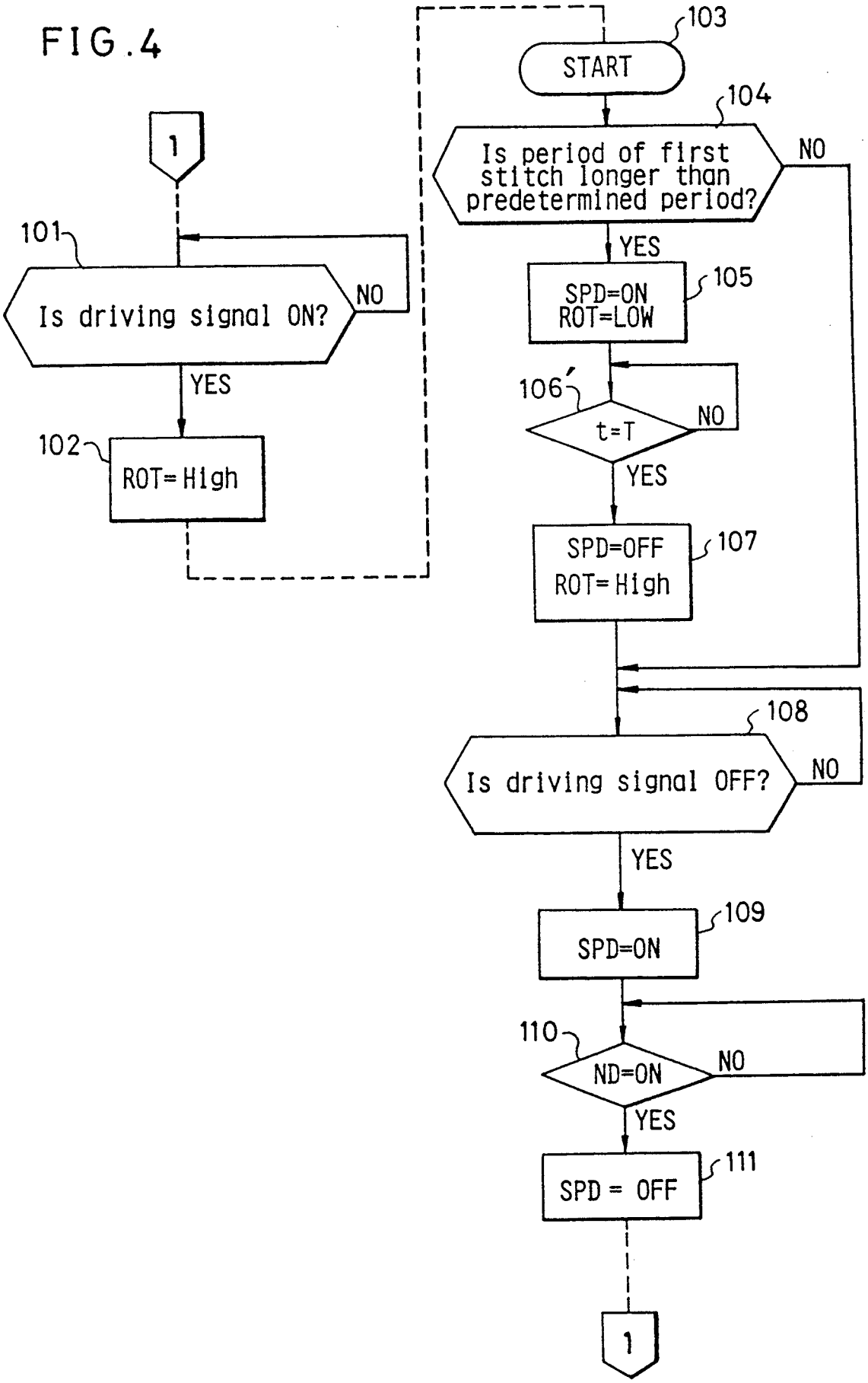
FIG. 4 is a flow chart showing operations of a sequence control means in a second embodiment of the sewing machine in accordance with the present invention.
Figure 5:
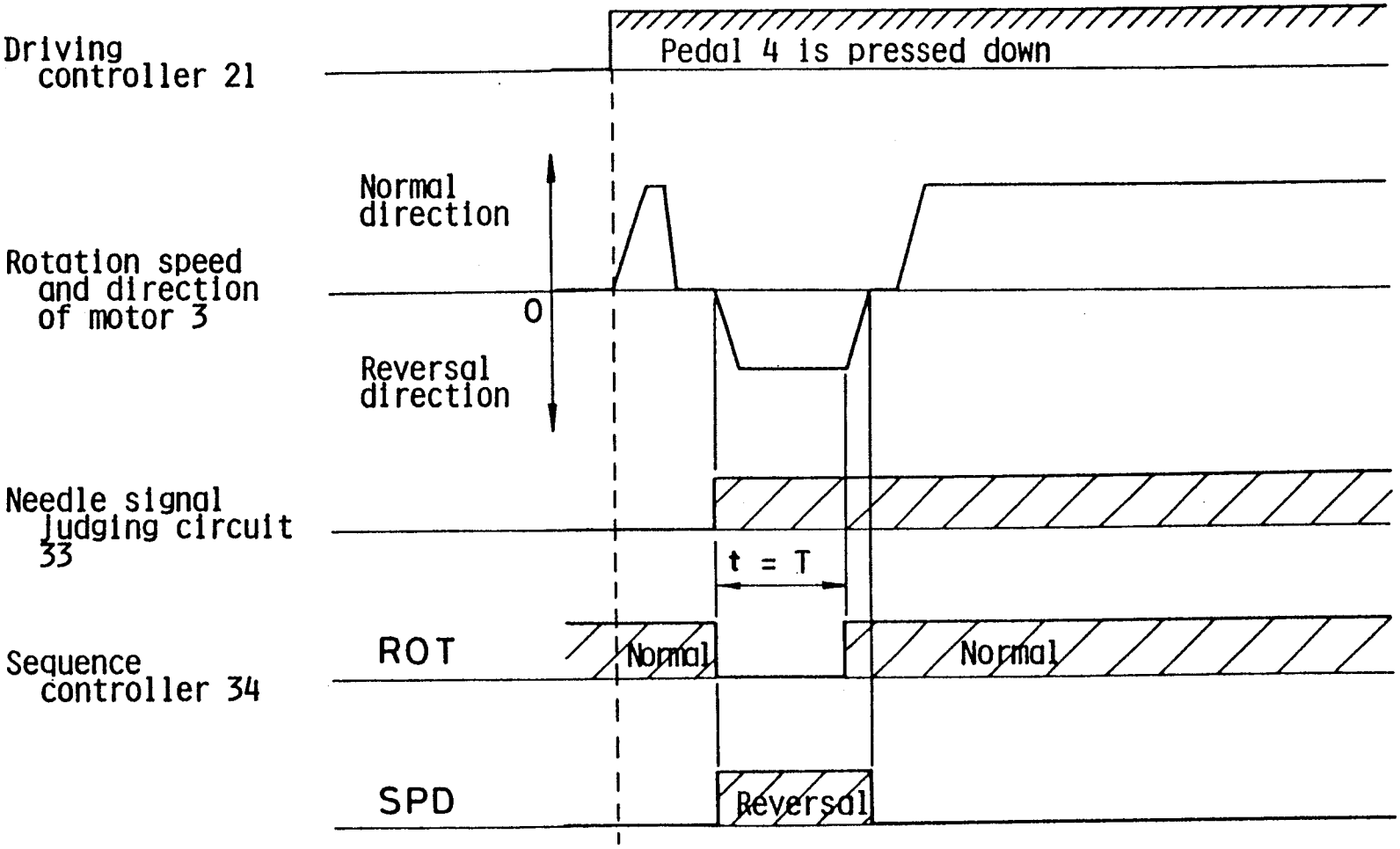
FIG. 5 is a timing chart in the sewing machine in the second embodiment shown in FIG. 4.

A second embodiment of the sewing machine in accordance with the present invention is described referring to FIGS. 4 and 5. FIG. 4 is a flow chart showing the operation of the sequence controller 34 in the second embodiment, and FIG. 5 is a timing chart thereof. The hard ware of the second embodiment is substantially the same as that of the first embodiment shown in FIG. 1

In the second embodiment, the sequence controller 34 outputs the signal for rotating the motor 3 in the reverse direction as shown in FIG. 4 during the time period T as shown in FIG. 5. For executing such an operation, the sequence controller 34 has a changeable timer shown in the step 106'. The angle for rotating the motor 3 in the reverse direction can easily be selected by adjustment of the timer. Thereby, a function of the needle position detector 8 for detecting that the needle reaches the needle-up position can be omitted from the first embodiment.

Figure 6:
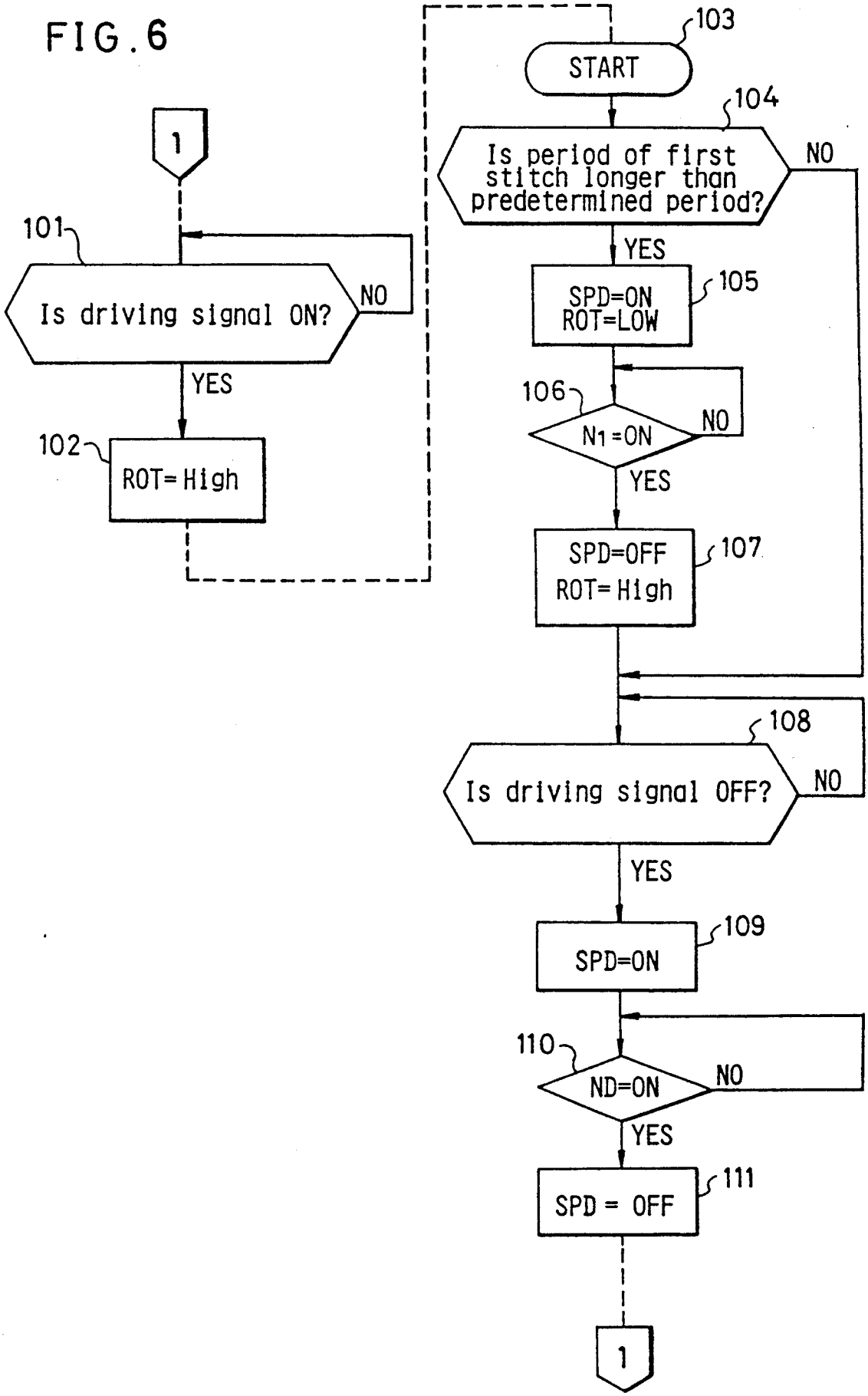
FIG. 6 is a flow chart showing operations of a sequence control means in a third embodiment of the sewing machine in accordance with the present invention.
Figure 7:
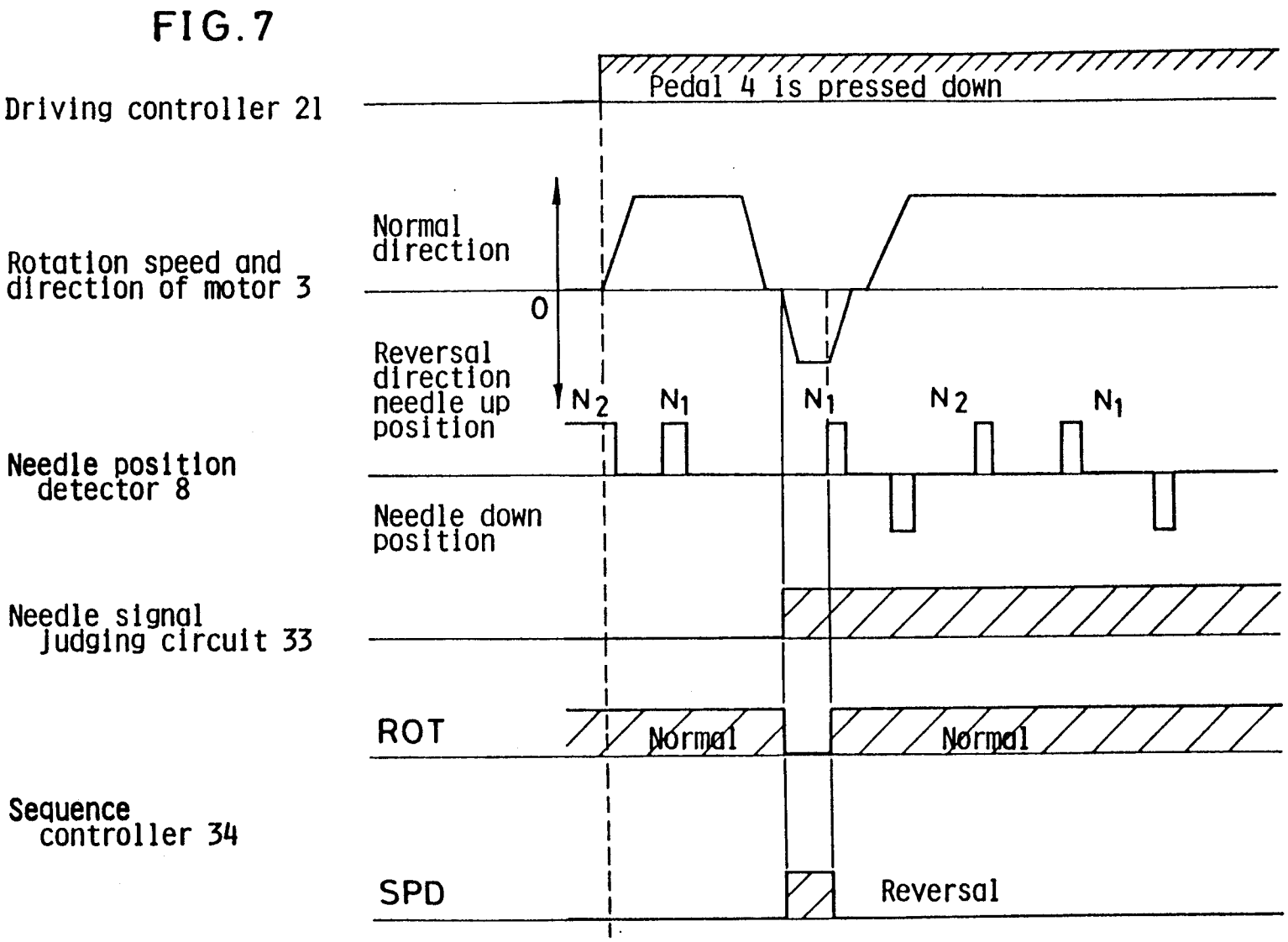
FIG. 7 is a timing chart in the sewing machine in the third embodiment shown in FIG. 6.
Figure 8:
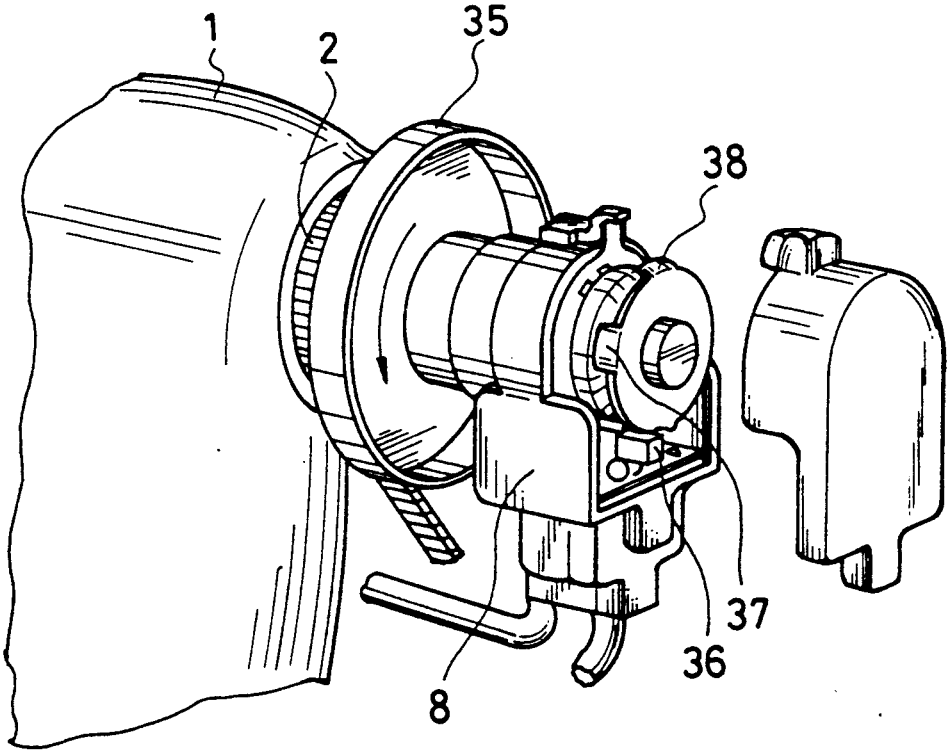
FIG. 8 is a perspective view showing details of a needle position detector of the sewing machine in accordance with the present invention.

A third embodiment of the sewing machine in accordance with the present invention is described referring to FIGS. 6, 7 and 8. FIG. 6 is a flow chart showing the operation of the sequence controller 34 in the third embodiment, and FIG. 7 is a timing chart thereof. FIG. 8 is a perspective view showing the details of the needle position detector 8 having two needle-up positions to be detected. One is fixed and the other is adjustable. Other elements for constituting the sewing machine is substantially the same as the afore-mentioned first and second embodiments.

In FIG. 8, the needle position detector 8 is disposed on a pulley 35 and comprises: a needle position sensor 36 for generating needle-up signal; a first reflector 37 mounted on a shaft of the pulley 35 at an adjustable predetermined position for reflecting a light from the needle position sensor 36; and a second reflector 38 mounted on the shaft at a fixed predetermined position near the upper dead point of the crank of the sewing machine 1. The needle position sensor 36 outputs a first needle-up signal $N_1$ when the first reflector 37 passes in front thereof, and a second needle-up signal $N_2$ (which corresponds to the needle-up signal NU in the first and second embodiments) when the second reflector 38 passes in front thereof.

Operations of the third embodiment is substantially the same as that of the first embodiment. However, a different point is that the signal for rotating the motor 3 in the reverse direction is continued to be outputted until the first needle-up signal $N_1$ is outputted. In the first embodiment, the needle-up signal NU corresponding to the second needle-up signal $N_2$ in the third embodiment which is outputted from the fixed needle sensor (reflector) near the upper dead point is used without any relation to the sequence operation of the sewing machine for stopping the rotation of the motor 3 in the reverse direction. Thereby, the rotation angle of the motor in the reversal direction is fixed. On the other hand in the third embodiment, the adjustable needle sensor such as reflector 37 is used. Thereby, the rotation angle of the motor in the reversal direction is also adjustable in the third embodiment.

In the afore-mentioned embodiments, the sequence controller 34 controls the driving and stopping of the motor 3 by using the output signal SPD and controls the direction thereof by using the output signal ROT. However, it is also possible to incorporate the ROT signals of rotation direction of the motor 3 with the SPD signals of the driving and stopping of the motor 3. Furthermore, other speed controllers and switches such as third and fourth are usable for controlling the motor in normal and reversal direction respectively different independent rotation speed.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A sewing machine comprising:

a motor for driving said sewing machine;

needle position detecting means for detecting a position of a needle of said sewing machine and outputting a needle position signal in response thereto;

speed control means for controlling a rotation speed of said motor; and sequence control means for controlling driving and stopping of said motor responding to a depth of a pedal, and for outputting a rotation direction signal to said speed control means to drive said motor in a reverse direction for a predetermined angle when a needle-down signal of a first stitch is within a predetermined time period from a start of said driving.

2. A sewing machine in accordance with claim 1, wherein said sequence control means includes timer means for counting a time period for rotating said motor in said predetermined angle.

3. A sewing machine in accordance with claim 1 wherein said sequence control means outputs said rotation direction signal to said speed control means for driving said motor in said reverse direction during the time said needle position detecting means outputs said needle position signal.

* * * * *